United States Patent [19]

Caputo et al.

[11] 4,373,612

[45] Feb. 15, 1983

[54] ELEVATOR SYSTEM

[75] Inventors: William R. Caputo, Wyckoff; Alan L. Husson, Hackettstown, both of N.J.

[73] Assignee: Westinghouse Electric Corp., Pittsburgh, Pa.

[21] Appl. No.: 210,439

[22] Filed: Nov. 25, 1980

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,774,729 | 11/1973 | Winkler | 187/29 |
| 4,131,183 | 12/1978 | Krauer | 187/29 |
| 4,136,758 | 1/1979 | Tachino | 187/29 |
| 4,155,426 | 5/1979 | Booker, Jr. | 187/29 |
| 4,261,439 | 4/1981 | Husson | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system including an elevator car, and control apparatus for controlling its speed, including a floor selector and a speed pattern generator. The speed pattern generator provides a running speed pattern, and a slowdown speed pattern. A smooth transfer from the running speed pattern to the slowdown speed pattern is achieved by the generation of first and second deceleration signals, and a transfer signal. When the floor selector issues a slowdown signal, the slowdown speed pattern is initiated and the first deceleration signal causes the running speed pattern to have a zero rate of change. First and second different relationships between the running speed pattern and the slowdown speed pattern then successively cause the issuance of the second deceleration signal and the transfer signal, with the second deceleration signal causing the running speed pattern to have a predetermined constant rate of change, less than that of the slowdown speed pattern, such that the patterns intersect. Pattern equality causes the issuance of the transfer signal, which initiates the substitution of the slowdown speed pattern for the running speed pattern.

6 Claims, 8 Drawing Figures

10
HALL LANTERNS
54
LIMIT SWITCHES IN HATCHWAY
FLOOR SELECTOR
34
SPEED PATTERN GENERATOR
48
DISTANCE PULSES NLC
TIMING
DOOR OPERATOR
52
PULSE DETECTOR
64
PULSE DETECTOR
32
TO CAR DOOR OPERATOR
MOTOR CONTROLLER
50
TIMING
CAR CALL CONTROL
38
TIMING
HALL CALL CONTROL
46
42
44
40
30 TH LANDING
2 ND LANDING
1ST LANDING
MOTOR
20
56
56
56
12
36
58
62
60
22
18
16
13
28
26
24
26A
30
14

TRAN
MXVM
ACCELERATION
SPS1
SPS2
DEC1
DEC2
ACC
542
590
+V
-V

ELEVATOR SYSTEM

BACKGROUND OF THE INVENTION

1. Field of the Invention

The invention relates in general to elevator systems, and more specifically to elevator systems in which the speed of an elevator car is controlled by a speed pattern generator.

2. Description of the Prior Art

U.S. Pat. No. 3,774,729, which is assigned to the same assignee as the present application, discloses an elevator system in which a speed pattern generator controls the speed of an elevator car by providing a time based speed pattern TRAN which accelerates the elevator car to, and then maintains, a predetermined running speed. When the elevator reaches a predetermined position relative to a target floor, the speed pattern generator substitutes a distance based speed pattern DSAN for the time based pattern, to control the speed of the elevator car during the slowdown phase of the run.

In order to provide a high quality ride, without noticeable "bumps" in the elevator car during a run, the transfer from the time based or running speed pattern to the distance based slowdown speed pattern must be stepless, i.e., the patterns should match at transfer time.

In the hereinbefore mentioned U.S. Patent, pattern transfer from the running speed pattern TRAN to the slowdown speed pattern DSAN is initiated after the running speed pattern has entered a slowdown phase, with transfer occurring when the running speed pattern reaches a preset maximum deceleration rate. Excellent performance is achieved when the pattern magnitudes match at the time of transfer, and the deceleration rate of the slowdown speed pattern is the same as the predetermined maximum deceleration value which was used to initiate pattern transfer. This ideal condition is rarely achieved because car response is not perfect and the time based speed pattern generator has some error which may cause the initiation of "turn-around" at the incorrect time. The term "term-around" refers to the transition interval from constant acceleration to constant deceleration, if the car has not yet reached constant velocity, or the transition interval from constant velocity to constant deceleration when it has. Thus, the running and slowdown patterns do not exactly match at transfer time, causing a "bump" to be felt by passengers in the elevator car. "Blending" the two speed patterns at pattern transfer time, as taught in U.S. Pat. No. 3,651,892, which is assigned to the same assignee as the present application, provides some improvement, but if turn-around is started as much as 0.2 second early, a bump is still felt in the car at pattern transfer, even when the signals or patterns are blended.

Copending application Ser. No. 073,822 filed Sept. 10, 1979, entitled "Elevator System", now U.S. Pat. No. 4,261,439, which is assigned to the same assignee as the present application, discloses an improvement for the elevator system of U.S. Pat. No. 3,774,729 in which the slowdown speed pattern DSAN is forced to match the running speed pattern TRAN prior to transfer between the speed patterns. Prior to pattern transfer, the invention of the copending application also automatically and continuously determines the deceleration rate to be used by the slowdown speed pattern after transfer. The value of this deceleration rate at the precise time of transfer is used to decelerate the elevator car at a constant rate. This deceleration rate cuases the slowdown speed pattern to have a predetermined value when the elevator car is at a predetermined location relative to the target floor, enabling stepless transfer at this predetermined location from the slowdown speed pattern DSAN to a landing speed pattern HTAN, which is initialized to the predetermined value. While this arrangement provides a very smooth transfer from the running speed pattern to the slowdown speed pattern, it does introduce another variable into the system, i.e. the variable slope of the slowdown pattern curve, which can be different on each run. While the control system is constructed to operate correctly with an adaptable deceleration rate, this additional variable is another error source which may lead to errors in pattern transfer from the slowdown pattern to the landing pattern. Thus, it would be desirable to improve the pattern transfer arrangement of U.S. Pat. No. 3,774,729, without changing the slope of the slowdown speed pattern curve.

The present invention improves upon the pattern transfer arrangement of U.S. Pat. No. 3,774,729, while maintaining the constant slope aspect of the slowdown speed pattern, by making the turn-around of the time-based running speed pattern adaptive, and thus non-critical. The turn-around will always be smooth and the approaches of the car to the target floor consistent.

SUMMARY OF THE INVENTION

Briefly, the present invention is a new and improved speed pattern controlled elevator system which provides a smooth bumpless transfer from a running speed pattern to a slowdown speed pattern by forcing the running speed pattern to provide a predetermined characteristic which includes a zero acceleration portion, even if the elevator car is still accelerating when turn-around is initiated. Then, when the running speed pattern has a predetermined relationship with the slowdown speed pattern, a constant deceleration portion is initiated which has a deceleration rate which is different (less) than the constant deceleration rate of the slowdown speed pattern, causing them to quickly cross. Pattern transfer is made when the patterns cross, i.e., are equal. While the deceleration rates of the two patterns are deliberately made different, the rate of change of acceleration at transfer, i.e., jerk, is maintained below 7.5 ft./sec.$^3$, which is very comfortable for passengers in the elevator car, by selecting the constant deceleration rate of the running speed pattern to be in the range of about 60 to 80% of the slowdown pattern, such as about 70%.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENT

Figure 1:
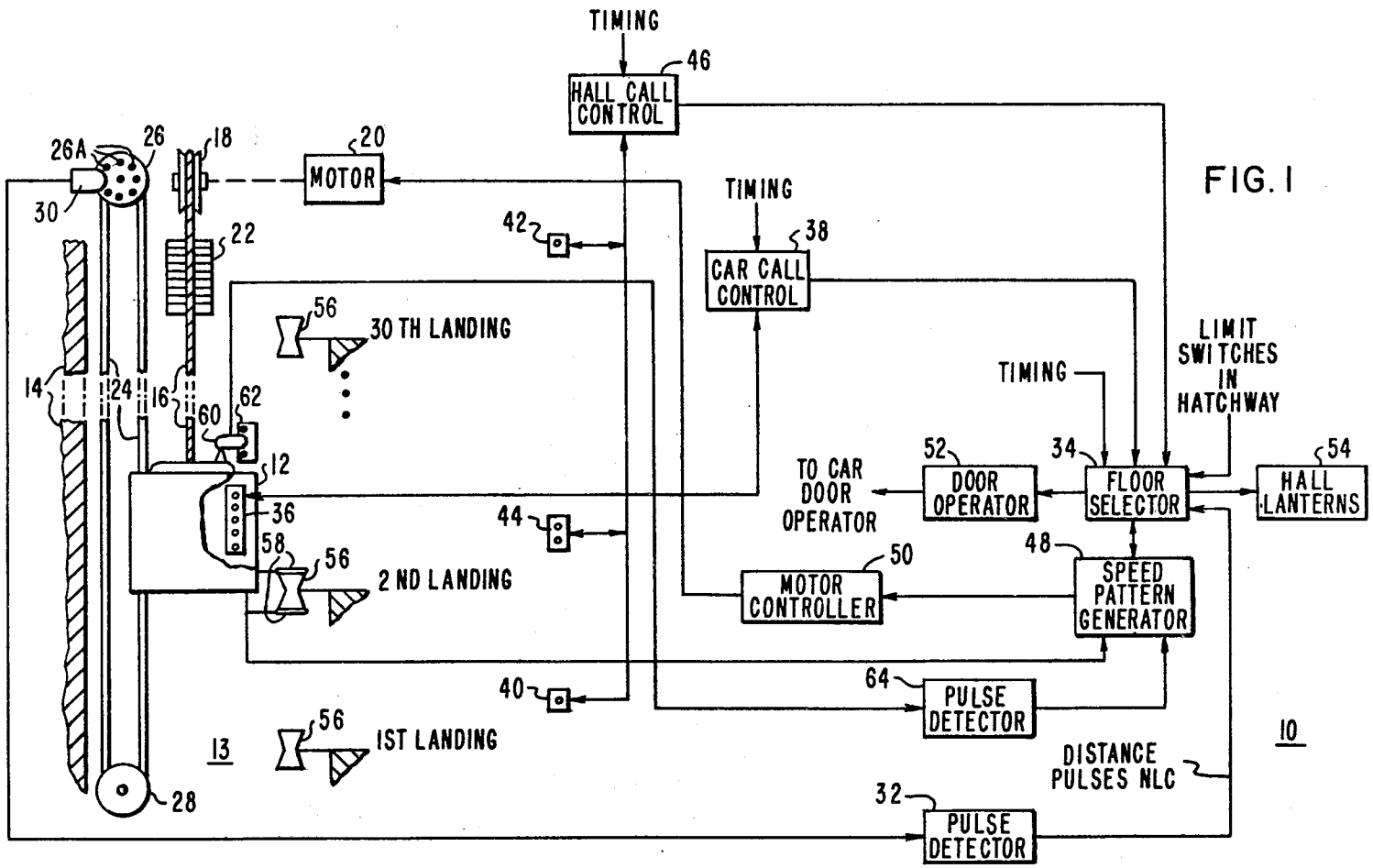
FIG. 1 is a partially schematic and partially block diagram illustrating an elevator system which may be constructed according to the teachings of the invention.
Figure 2:
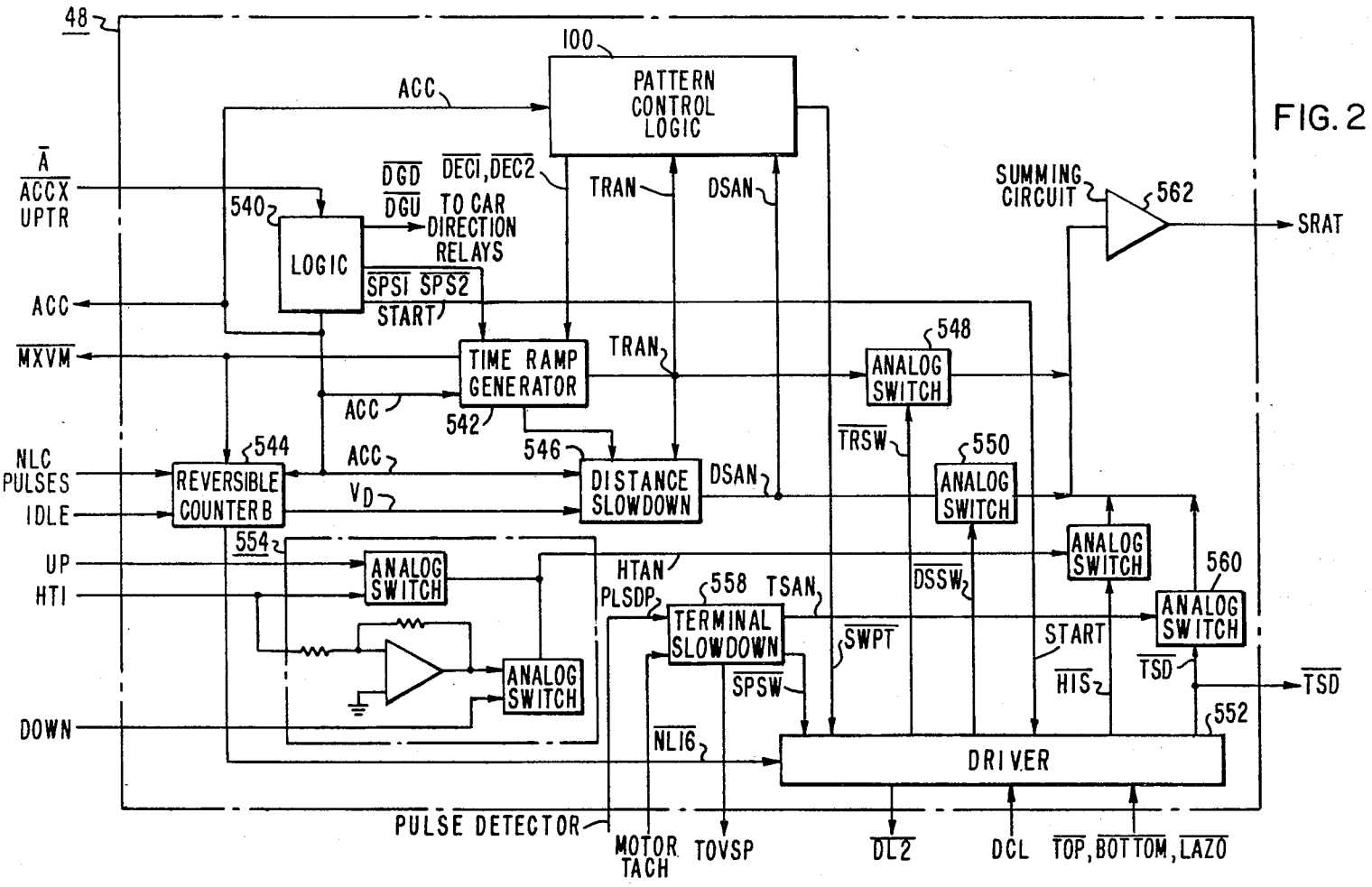
FIG. 2 is a partially block and partially schematic diagram of a speed pattern generator constructed according to the teachings of the invention, for use in the elevator system of FIG. 1.
Figure 4:
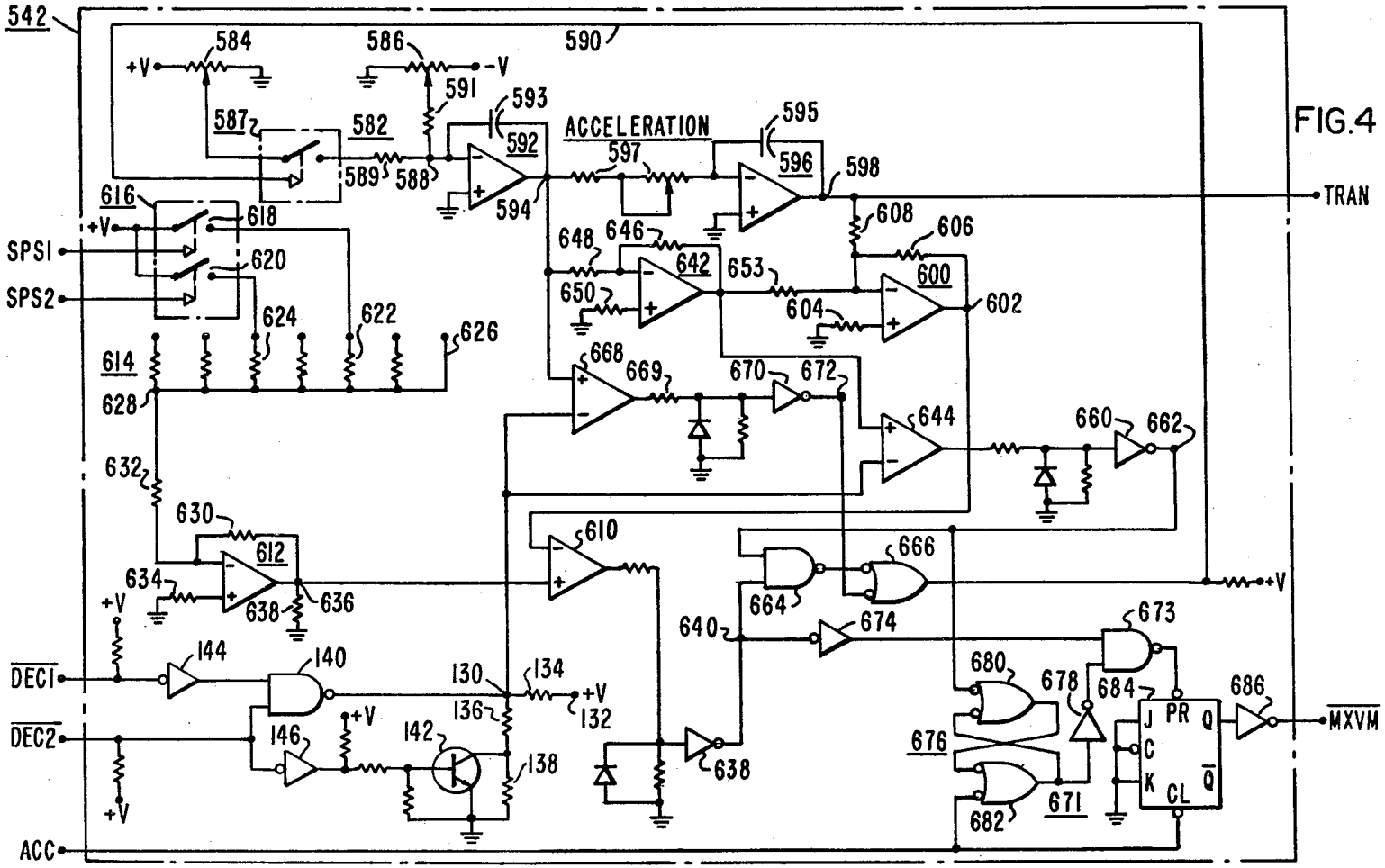
FIG. 4 is a schematic diagram of a time dependent speed pattern generator shown in block form in FIG. 2, modified according to the teachings of the invention.

The invention is a new and improved elevator system, and in order to reduce the complexity of the drawing and specification the hereinbefore mentioned U.S. Pat. No. 3,774,729, is hereby incorporated into the present application by reference. The present invention will be described by illustrating how the elevator system of the incorporated patent would be modified to operate according to the teachings of the invention, and thus only the modifications thereto will be described in detail. FIG. 1 is the same as FIG. 1 of the incorporated patent, and is included to broadly show an elevator system of the type which may utilize the invention. FIG. 2 is similar to FIG. 12 of the incorporated patent, except for the addition of a pattern control logic function 100, to be hereinafter described. FIG. 4 is FIG. 14 of the incorporated patent modified to illustrate how the output of the pattern control logic function 100 may be used to control turn-around of the time based running speed pattern TRAN.

The reference numerals in FIGs. 1, 2 and 4 are the same as those in FIGS. 1, 12 and 14, respectively, of the incorporated patent, for ease of comparison.

Briefly, FIG. 1 illustrates an elevator system 10 wherein a car 12 is mounted in a hatchway 13 for movement relative to a structure 14 having a plurality of landings, such as thirty, with only the first, second and thirtieth landings being shown in order to simplify the drawing. The car 12 is supported by wire ropes 16 which are reeved over a traction sheave 18 mounted on the shaft of a drive motor 20, such as a direct current motor as used in the Ward-Leonard, or in a solid state, drive system. A counterweight 22 is connected to the other ends of the ropes 16. A governor rope 24, which is connected to the car 12, is reeved over a governor sheave 26 located above the highest point of travel of the car in the hatchway 13, and over a pulley 28 located at the bottom of the hatchway. A pickup 30 is disposed to detect movement of the car 12 through the effect of circumferentially spaced openings 26A in the governor sheave 26. The openings in the governor sheave are spaced to provide a pulse for each standard increment of travel of the car, such as a pulse for each 0.5 inch of car travel. Pickup 30, which may be of any suitable type, such as optical or magnetic, provides pulses in response to the movement of the openings 26A in the governor sheave. Pickup 30 is connected to a pulse detector 32 which provides distance pulses NLC for a floor selector 34. Distance pulses NLC may be developed in any other suitable manner, such as by a pickup disposed on the car which cooperates with regularly spaced indicia in the hatchway.

Car calls, as registered by pushbutton array 36 mounted in the car 12, are recorded and serialized in car call control 38, and the resulting serialized car call information is directed to the floor selector 34. Hall calls, as registered by pushbuttons mounted in the hallways, such as the up pushbutton 40 located at the first landing, the down pushbutton 42 located at the thirtieth landing, and the up and down pushbuttons 44 located at the second and other intermediate landings, are recorded and serialized in hall call control 46. The resulting serialized hall call information is directed to the floor selector 34.

The floor selector 34 processes the distance pulses from pulse detector 32 to develop information concerning the postion of the car 12 in the hatchway 13, and it also directs these processed distance pulses to a speed pattern generator 48 which generates a speed reference signal for a motor controller 50, which in turn provides the drive voltage for motor 20.

The floor selector 34 keeps track of the car 12, the calls for service for the car, it provides the request to accelerate signal (signal $\overline{ACCX}$ goes low) to the speed pattern generator 48, and it provides the deceleration signal for the speed pattern generator 48 (signal $\overline{ACCX}$ goes high). The deceleration signal is provided at the precise time required for the car to start the slowdown phase of the run to decelerate according to a predetermined deceleration schedule and stop at a predetermined target floor for which a call for service has been registered. This is accomplished by comparing an advanced car position with the location of the target floor, with the deceleration signal being provided when they are equal. The floor selector 34 also provides signals for controlling such auxiliary devices as the door operator 52 and the hall lanterns 54, and it controls the resetting of the car call and hall call controls when a car or corridor call has been serviced.

Landing, and leveling of the car at the landing, is accomplished by a hatch transducer system which utilizes inductor plates 56 disposed at each landing, and a transformer 58 disposed on the car 12.

The motor controller 50 includes a speed regulator responsive to the reference pattern provided by the speed pattern generator 48. The speed control may be derived from a comparison of the actual speed of the motor and that called for by the reference pattern.

An overspeed condition near either the upper or lower terminal is detected by the combination of a pickup 60 and slowdown blades, such as a slowdown blade 62.

FIG. 2 is a schematic diagram of a speed pattern generator which may be used for the speed pattern generator 48 shown in FIG. 1. The speed pattern generator 48 provides a signal for the motor controller 50 which controls the speed of the drive motor 20, and thus the movement of the car 12. In elevator systems, the speed and position of the car must be precisely controlled for the safety and comfort of the passengers, while being responsive to calls for service at any time.

The speed pattern generator 48 receives signals $\overline{ACCX}$ and UPTR from the floor selector 34, responsive to a request for acceleration, and travel direction request, respectively, which signals are processed in logic circuit 540 to provide signals $\overline{DGU}$ and $\overline{DGD}$ for the car direction relays, acceleration signal ACC, speed signals $\overline{SPS1}$ or $\overline{SPS2}$ for a time based running speed pattern generator circuit 542, and a start signal START for a driver circuit 552. The running speed pattern generator 542 provides a time dependent signal TRAN which is used for the acceleration, full speed and transition between full speed and maximum deceleration phases of the run, with the speed pattern generator 48 sequentially switching to distance based slowdown speed patterns DSAN and HTAN for the maximum deceleration and landing phases of the run, respectively.

A reversible counter 544 receives the distance pulses NLC. Counter 544 is responsive to signal $\overline{MXVM}$ from the running speed pattern generator 542, which goes to logic ZERO when maximum speed of the car is reached, and signal ACC goes to the logic ZERO level when deceleration is requested. These signals program counter 544 to (a) count up in response to the NLC distance pulses while the car is accelerated, to (b) stop counting when the car reaches maximum speed ($\overline{MXVM}$ goes to ZERO), which thus stores the distance to go to a landing, and to (c) count down when the deceleration is initiated (ACC goes to ZERO).

The output of counter 544 is applied to a distance based slowdown circuit 546, which provides the speed reference signal DSAN. The switching from the time dependent running pattern signal TRAN to the distance dependent slowdown pattern signal DSAN is accomplished by switches 548 and 550 and a driver circuit 552 which provides switching signals $\overline{TRSW}$ and $\overline{DSSW}$ at the proper time for operating analog switches 548 and 550, respectively. This pattern substitution is controlled, according to the teachings of the invention, by pattern control logic 100 which provides first and second deceleration signals $\overline{DEC1}$ and $\overline{DEC2}$, respectively, for time ramp generator 542. Logic 100 also provides a transfer signal $\overline{SWPT}$ for driver 522, in response to the acceleration signal ACC, which goes low at the start of the slowdown phase of a run, and in response to the running and slowdown speed pattern signals TRAN and DSAN, respectively. Signal $\overline{MINA}$ from the distance slowdown function 546, which initiated pattern transfer in the incorporated patent when the time based pattern TRAN reached maximum deceleration, has been replaced by signal $\overline{SWPT}$. Signal $\overline{SWPT}$ initiates pattern transfer when it goes low, using exactly the same switching arrangement as the apparatus responsive to signal $\overline{MINA}$.

When the car 12 is within a predetermined distance from the target floor at which it is to stop, such as 10 inches, a signal HT1 from a hatch transducer is applied to a switching arrangement 554, which is also responsive to the car travel direction, signals UP and DOWN. Signal UP is true when the car is traveling upwardly, and signal DOWN is true when the car is traveling downwardly. Switching arrangement 554 provides a speed reference signal HTAN for an analog switch 556, which receives a switching signal $\overline{HIS}$ from driver 552 at the proper time to switch from the slowdown speed reference signal DSAN to the hatch transducer speed reference signal HTAN.

The signals from the analog switches driven by the driver 552 are applied to a summing amplifier 562, which provides a speed reference signal SRAT for the motor controller 50, shown in FIG. 1, which may be conventional.

A binary count, stored in counter 544 represents the distance of the elevator car from the target floor, and this count is changed to an analog voltage signal $V_D$. When the elevator car is to stop at a selected target floor, signal ACC goes low precisely when the elevator car reaches the distance from the target floor which corresponds to the binary count already in the counter, signifying the arrival of the advanced car position at the target floor. The counter then starts counting down in response to the distance pulses NLC, when signal ACC goes low. Broadly, the slowdown speed pattern generator 546 takes the square root of the distance-to-go signal $V_D$ to develop the speed pattern DSAN. Transfer from the running speed pattern TRAN to the slowdown speed pattern DSAN, however, is not made at this time. When signal ACC goes low, the running speed pattern TRAN is modified according to the teachings of the invention, with the pattern control logic 100 shown in FIGS. 2 and 3 developing the necessary signals for such modification.

Figure 3:
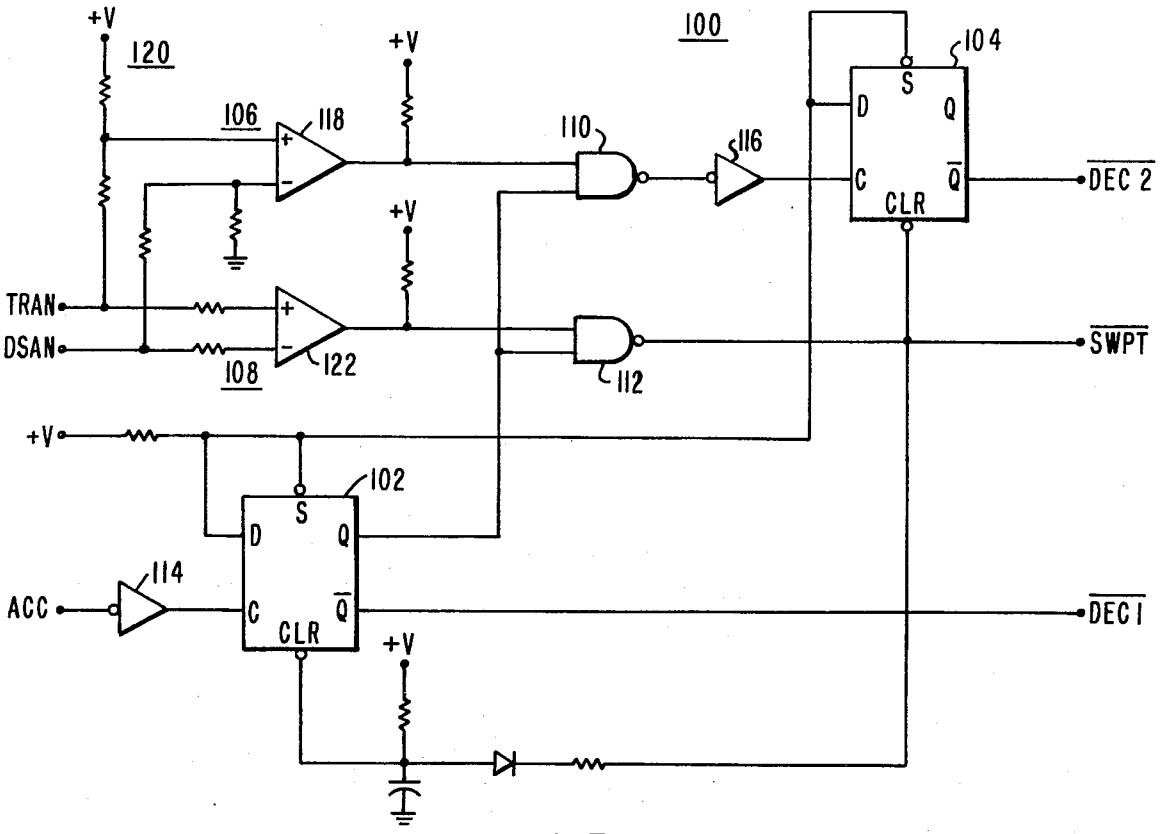
FIG. 3 is a schematic diagram of pattern control logic shown in block form in FIG. 2.

More specifically, FIG. 3 is a schematic diagram which sets forth circuitry which may be used to implement pattern control logic 100. Logic 100 includes first and second edge triggered D-type flip-flops 102 and 104, such as Texas Instruments SN7474, first and second comparators 106 and 108, first and second NAND gates 110 and 112, and first and second inverter gates 114 and 116. When the advanced car position reaches the address of the target floor, comparator 76 in FIG. 5 of the incorporated patent provides a true signal $\overline{EQ2}$, signal DEC in FIG. 10 goes true, signal $\overline{ACCX}$ in FIG. 9 goes high, and signal ACC in FIG. 13 goes low. Signal ACC is applied to the clock input of flip-flop 102 via inverter gate 114. The D input of flip-flop 102 is tied high. Thus, when signal ACC goes low to signify the start of the slow-down phase of the run, the rising edge of the logic one output signal of inverter gate 114 transfers the logic one at the D input to the Q output, and output Q goes low to provide the first of two deceleration signals to be provided, i.e., signal $\overline{DEC1}$. When signal $\overline{DEC1}$ goes low, it starts the first modification of the running speed pattern TRAN, as will be hereinafter explained. The high Q output of flip flop 102 is used to enable NAND gates 110 and 112.

When signal ACC goes low, it also starts the generation of the distance based speed pattern DSAN. First and second comparisons between the time based running speed pattern TRAN and the distance based slowdown speed pattern DSAN are made in comparators 106 and 108, with these comparisons being made effective when NAND gates 110 and 112 are enabled at the time signal ACC goes low.

The first comparator 106 includes an operational amplifier (op amp), such as LM-311, and bias means 120 for adding a predetermined bias voltage to pattern TRAN. The second comparator 108 includes an op amp 122, which directly compares patterns TRAN and DSAN, i.e., they are compared without bias. Pattern TRAN, plus bias, is applied to the non-inverting input of op amp 118, and pattern DSAN is applied to its inverting input. Pattern DSAN starts higher than the value of TRAN plus the bias, and the output of op amp 118 is initially a logic zero. When the magnitude of pattern TRAN plus bias equals the magnitude of pattern DSAN, the output of op amp 118 switches to a logic one. The output of NAND gate 110 goes low and inverter gate 116 applies a logic one to the clock input of flip-flop 104. This causes its $\overline{Q}$ output to go low and provide the second of two deceleration signals used to modify the running speed pattern TRAN, i.e., signal $\overline{DEC2}$. When signal $\overline{DEC2}$ goes low, it signifies the occurrence of a first predetermined relationship between the two speed pattern signals, i.e., pattern TRAN is within the bias magnitude of equaling the magnitude of pattern DSAN. Signal DEC2, when it goes low, modifies the running speed pattern TRAN, as will be hereinafter explained.

Comparator 108 continues to directly compare speed patterns TRAN and DSAN, with op amp 122 outputting a logic zero until the magnitude of pattern TRAN is equal to the magnitude of pattern DSAN, at which time op amp 122 outputs a logic one, causing the output of NAND gate 112 to go low and provide a true transfer signal SWPT. As shown in FIG. 2, when signal SWPT goes low, the pattern transfer means which includes driver 552 and analog switches 548 and 550 operates to substitute pattern DSAN for pattern TRAN. When the output of NAND gate 112 goes low to initiate pattern transfer, it also resets flip-flops 102 and 104, to initialize them for the next run.

FIG. 4 is a schematic diagram of the running speed pattern generator 542, illustrating how the two deceleration signals $\overline{DEC1}$ and $\overline{DEC2}$ modify the running speed pattern TRAN. Since the incorporated patent may be referred to for the details of speed pattern generator 542, only the modifications thereto will be described. The modifications are made in the acceleration reference portion of the circuit. Comparator 668 compares the acceleration or rate of change of the speed pattern being generated with a reference level, with the former being applied to the non-inverting input of comparator 668, and the latter to its inverting input. During acceleration, signals $\overline{DEC1}$ and $\overline{DEC2}$ are both high, and the full selected acceleration reference is operational, as selected by the voltage appearing at terminal 130 of a voltage divider which includes a source 132 of unidirectional potential, and serially connected resistors 134, 136 and 138, which are connected in the recited order from source 132 to ground.

The pattern modification circuit includes NAND gate 140, NPN transistor 142, and inverter gates 144 and 146. Signal $\overline{DEC1}$ is applied to an input of NAND gate 140 via inverter gate 144. Signal $\overline{DEC2}$ is applied directly to the remaining input of NAND gate 140, and to the base of transistor 142 via inverter gate 146. Deceleration signal $\overline{DEC1}$ goes low at the instant the slowdown phase of the run is initiated, and the output of NAND gate 140 goes low, dropping the voltage at terminal 130 and thus the acceleration reference signal, to zero. If the run is a short run, and pattern TRAN is still in its acceleration phase, the speed pattern will be smoothly changed to a zero rate of change, because of the jerk constraints built into pattern generator 542. If the pattern TRAN has already reached its maximum velocity portion, the switching of signal $\overline{DEC1}$ low will have no affect on pattern TRAN, since its rate of change will already be zero.

When the first predetermined relationship between patterns TRAN and DSAN occurs, signified by the second deceleration signal $\overline{DEC2}$ switching from a logic one to a logic zero, the output of NAND gate 140 switches from a logic zero to a logic one and transistor 142 is turned on to shunt resistor 138. The values of the resistors in the voltage divider are selected such that the shorting of resistor 138 by the collector and emitter electrodes of transistor 142 provides a reference voltage at terminal 130 which is in the range of about 60 to 80% of the rated full acceleration value, with a value such as 70% being excellent. The rate of change or deceleration rate of pattern DSAN will usually be equal in magnitude to the rated full acceleration value, and the deceleration reference level selected when signal $\overline{DEC2}$ goes low is that percentage of rated acceleration which will quickly cause pattern TRAN to cross pattern DSAN, but with slope differences which will not cause jerk in excess of about 7.5 ft./sec.$^3$ when the DSAN pattern is substituted for the TRAN pattern at this crossing point. A reference level of about 70% of the full acceleration reference level will meet these requirements.

Figure 5:
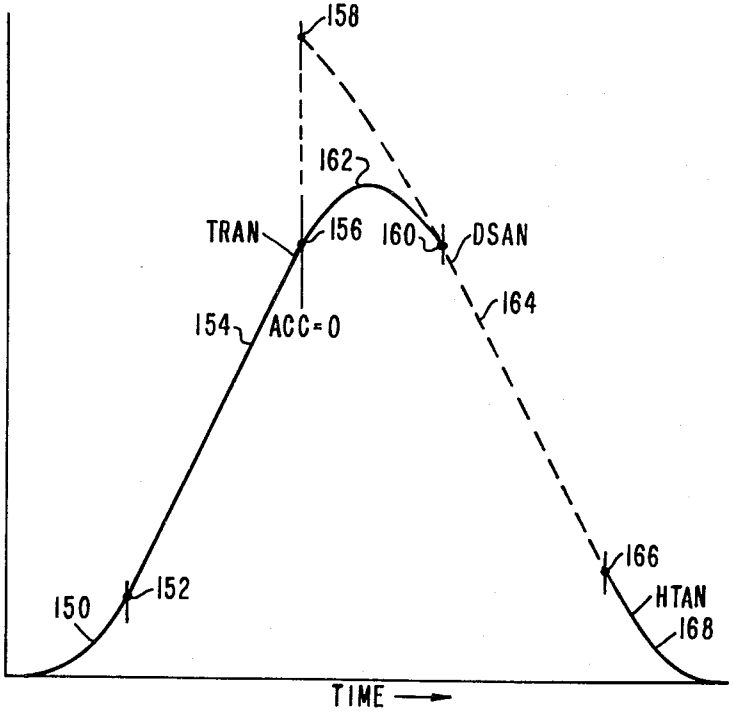

The graphs shown in FIGS. 5, 6, 7 and 8 will aid in understanding the invention. FIG. 5 illustrates the ideal pattern transfer from the running speed pattern TRAN to the slowdown speed pattern DSAN, with turn-around being illustrated as occurring before the maximum velocity or zero acceleration portion of the run occurs. Pattern TRAN starts at zero magnitude, it increass its rate of change along curve portion 150, and it quickly reaches maximum acceleration at point 152. It then follows curve portion 154 to point 156, at which point signal ACC goes low to start the slowdown phase of the run. When signal ACC goes low, pattern DSAN starts at a magnitude at point 158, which exceeds the magnitude of signal TRAN. If the car response is perfect, if turn-around was started at precisely the correct time, and speed pattern generator 542 has no error, speed pattern TRAN will smoothly change from maximum acceleration at point 156 to maximum deceleration at point 160, following curve portion 162. When maximum deceleration occurs, the pattern transfer is made at point 160. Speed pattern DSAN then controls the speed of the elevator car over curve portion 164 until reaching a predetermined distance from floor level, indicating at point 166, with the landing speed pattern HTAN, then being substituted for the distance pattern DSAN. The landing speed pattern brings the elevator car smoothly to floor level via curve portion 168.

Figure 6:
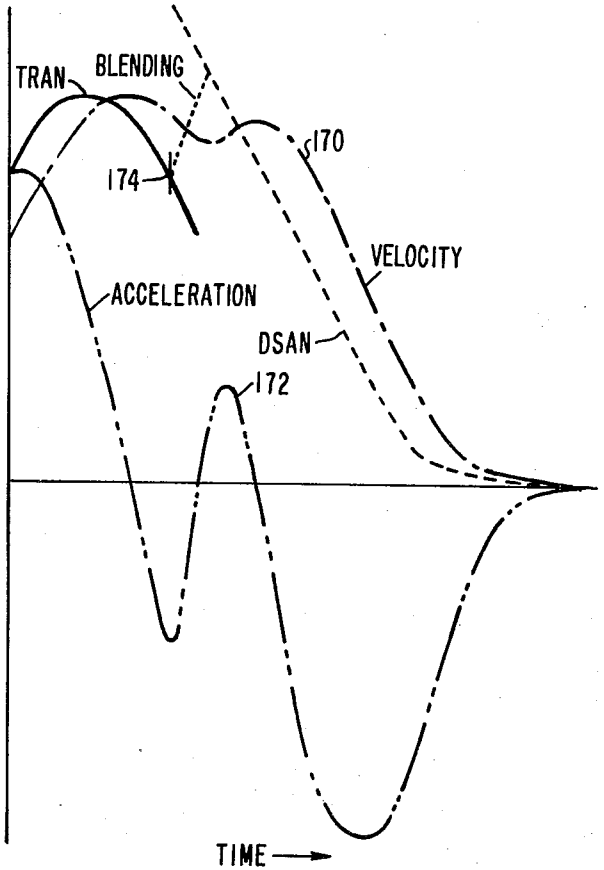
FIGS. 5, 6, 7 and 8 are graphs useful in understanding the invention.

This ideal response of the elevator car is seldom achieved, however, because the elevator car response is not perfect, and the speed pattern generator for generating pattern TRAN will have some error. FIG. 6 illustrates the car response when turn-around is started just 0.2 second early using the system of the incorporated patent. Curves 170 and 172 indicate car velocity and acceleration, respectively. Instead of pattern TRAN smoothly meeting pattern DSAN, as in FIG. 5, when pattern TRAN reaches maximum deceleration at point 174 pattern transfer is made, notwithstanding the difference in the magnitudes of the patterns. Even when using the signal blending of the hereinbefore mentioned patent, the acceleration curve exhibits large excursions around zero, which cause the "bump", which is felt in the elevator car.

Figure 7:
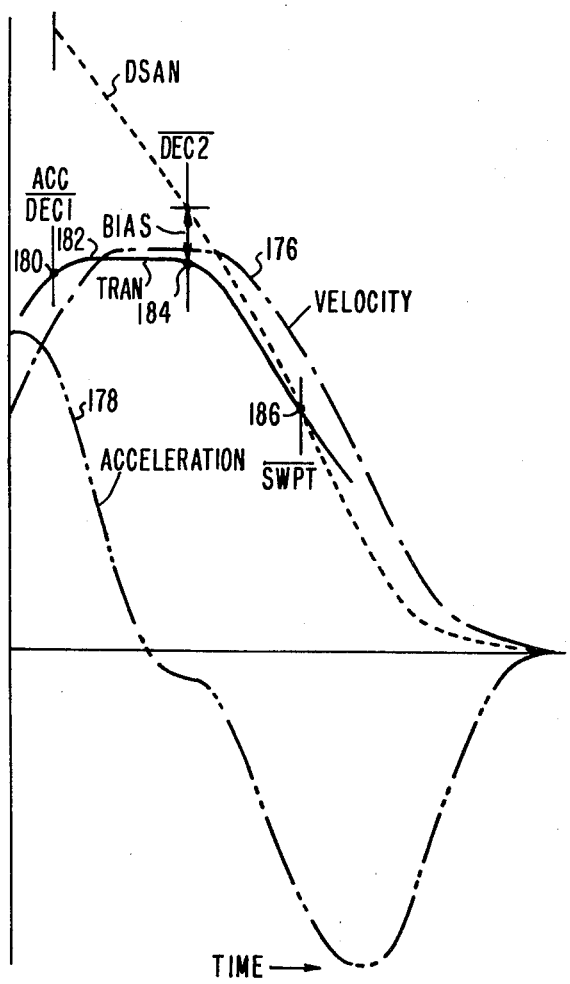

FIG. 7 illustrates car response when using the teachings of the invention, with curves 176 and 178 illustrating car velocity and acceleration, respectively. When signal ACC goes low at point 180, the first deceleration signal $\overline{DEC1}$ also goes low to change the acceleration reference to zero. If the pattern is still in its acceleration phase, as illustrated, it is smoothly reduced to zero acceleration and the car velocity remains constant during the latter portion of curve portion 182. Meanwhile, the patterns TRAN and DSAN are being compared to detect a first predetermined relationship, i.e., DSAN minus TRAN=BIAS. This relationship is detected at point 184 and the second deceleration signal $\overline{DEC2}$ goes low to change the acceleration reference to about 70% of the deceleration rate of slowdown pattern DSAN. Thus, both patterns TRAN and DSAN have a similar downward slope, but since pattern TRAN has a deceleration rate which was deliberately selected to be about 70% of the deceleration rate of pattern DSAN, they quickly cross at point 186. The second comparator function detects this relationship and the transfer signal $\overline{SWPT}$ is generated which initiates pattern substitution. Since the patterns are equal at the transfer point, with only about a 30% difference in their deceleration rates, transfer occurs without the wide excursions in the acceleration about zero, and thus a noticeable bump is not generated.

Figure 8:
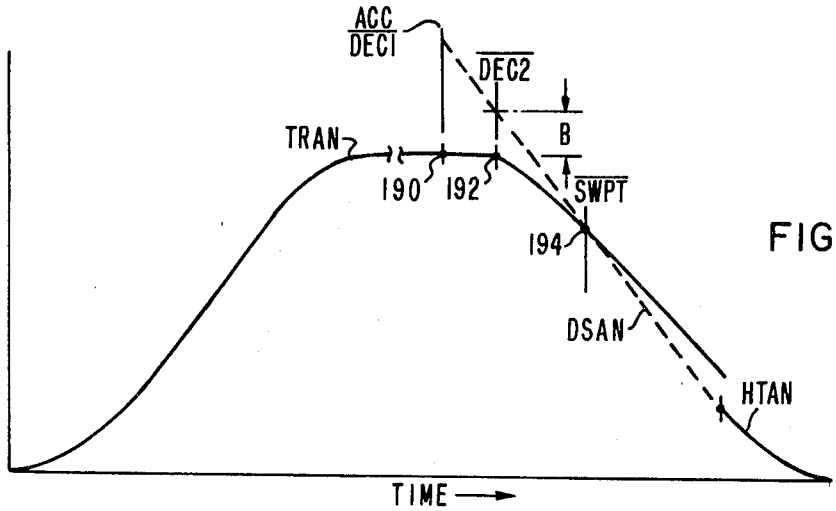

FIG. 8 is similar to FIG. 7, except it illustrates the operation of the invention when pattern TRAN is already in its maximum velocity portion at the time the slowdown phase is initiated. Since the acceleration rate is already zero when signals ACC and $\overline{DEC1}$ go low at point 190, pattern TRAN is not modified until signal $\overline{DEC2}$ goes low at point 192. Pattern transfer occurs when signal $\overline{SWPT}$ goes low at the pattern crossing point 194.

In summary, the invention is a new and improved elevator system which makes turn-around of the time based running speed pattern non-critical. It eliminates the "bump" when pattern substitution is made from the running speed pattern to the slowdown speed pattern, while retaining the fixed deceleration rate of the slowdown pattern. This makes transfer from pattern DSAN to the landing pattern HTAN more consistent.

We claim as our invention:

1. An elevator system, comprising:

a structure having a plurality of floors, an elevator car mounted for movement in said structure to serve the floors, motive means for causing said elevator car to make a run and stop at a target floor, control means for said motive means, including speed pattern means for providing a speed pattern indicative of the desired speed of the elevator car during at least a portion of a run, and floor selector means, said speed pattern means including first speed pattern means providing a running speed pattern which increases its magnitude from zero to a constant value to control the speed of the elevator car when the elevator car is to make a run and accelerate towards a predetermined constant velocity, said floor selector means providing a slowdown signal when said elevator car reaches a predetermined distance from a target floor during a run, said speed pattern means additionally including second speed pattern means providing a slowdown speed pattern in response to the issuance of said slowdown signal, said first speed pattern means including:

(a) means providing a first deceleration signal in response to said slowdown signal, (b) means responsive to said first deceleration signal which reduces the rate of change of the running speed pattern to zero, if its rate of change is not already zero when said slowdown signal is provided, (c) first comparator means providing a second deceleration signal in response to a first predetermined relationship between said running and said slowdown speed patterns, (d) means responsive to said second deceleration signal which reduces the magnitude of said running speed pattern at a predetermined constant rate of change, which rate is less than the predetermined constant rate of change of said slowdown speed pattern, and (e) second comparator means providing a transfer signal in response to a second predetermined relationship between said running and said slowdown speed patterns, (f) and transfer means substituting said slowdown speed pattern for said running speed pattern in response to the issuance of said transfer signal, with said slowdown speed pattern controlling the speed of said elevator car following said substitution.

2. The elevator system of claim 1 wherein the first predetermined relationship between the running speed pattern and the slowdown speed pattern occurs when the magnitude of the running speed pattern plus a predetermined bias is equal to the magnitude of the slowdown speed pattern.

3. The elevator system of claim 1 wherein the second predetermined relationship between the running speed pattern and the slowdown speed pattern occurs when the magnitude of the running speed pattern is equal to the magnitude of the slowdown speed pattern.

4. The elevator system of claim 1 wherein the first predetermined relationship between the running speed pattern and the slowdown speed pattern occurs when the magnitude of the running speed pattern plus a predetermined bias is equal to the magnitude of the slowdown speed pattern, and the second predetermined relationship between the running speed pattern and the slowdown speed pattern occurs when the magnitude of the running speed pattern is equal to the magnitude of the slowdown speed pattern.

5. The elevator system of claim 1 wherein the predetermined constant deceleration rate of the running speed pattern is about 60 to 80% of the magnitude of the constant deceleration rate of the slowdown speed pattern.

6. The elevator system of claim 1 wherein the first speed pattern means includes comparator means and reference means for determining the maximum rate of change of the running speed pattern, with the means responsive to the first deceleration signal causing said reference means to provide a zero reference for said comparator means, and with the means responsive to the second deceleration signal causing said reference means to provide a reference level indicative of the desired predetermined constant rate of change.

* * * * *